US005172862A

United States Patent [19]

Heimann et al.

[11] Patent Number: 5,172,862

[45] Date of Patent: Dec. 22, 1992

[54] SHOWER HEAD

[75] Inventors: Bruno Heimann, Fröndenberg-Ardey; Friedrich Wagner, Endingen; Bernd Bischoff, Iserlohn; Hans-Peter Strelow, Freiburg, all of Fed. Rep. of Germany

[73] Assignee: Friedrich Grohe Aktiengesellschaft, Hemer, Fed. Rep. of Germany

[21] Appl. No.: 633,483

[22] Filed: Dec. 27, 1990

[30] Foreign Application Priority Data

Dec. 28, 1989 [DE] Fed. Rep. of Germany ..... 3943062

[51] Int. Cl.[5] ..... B05B 15/02

[52] U.S. Cl. ..... 239/114; 239/546; 239/602

[58] Field of Search ..... 239/533.13, 106, 602, 239/104, 114–117

[56] References Cited

U.S. PATENT DOCUMENTS

| | | | |
|---|---|---|---|
| 1,493,359 | 5/1924 | Mallery . | |
| 2,402,741 | 6/1946 | Draviner | 239/602 X |
| 2,953,248 | 9/1960 | Troland | 239/602 X |
| 3,214,102 | 10/1965 | Meyer | 239/533.13 X |
| 3,373,942 | 3/1968 | Roman et al. | 239/602 X |
| 3,402,893 | 9/1968 | Hindman | 239/546 |
| 4,412,632 | 11/1983 | Berger et al. | 222/148 |

FOREIGN PATENT DOCUMENTS

| | | |
|---|---|---|
| 3044310 | 6/1982 | Fed. Rep. of Germany . |
| 3107808 | 9/1982 | Fed. Rep. of Germany . |

*Primary Examiner*—Andres Kashnikow
*Assistant Examiner*—Kevin P. Weldon
*Attorney, Agent, or Firm*—Herbert Dubno; Andrew Wilford

[57] ABSTRACT

A shower head has a body having a wall and forming therewith a pressurizable compartment. This wall has an inner face in the compartment and an outer face and is formed therebetween with an array of throughgoing perforations. Respective flexible tubular extensions are provided on the outer face of the wall at the perforations. These extensions can be deformed to flake off lime formations adhering to the extensions. The extensions can be unitary with the wall, in which case the wall is made of an elastomer, or respective tubular liners in the perforations having outer ends projecting past the outer face can form the respective extensions. In this case each liner can have laterally projecting inner and outer ridges respectively bearing against the inner and outer faces of the wall. Furthermore each liner has a predetermined diameter of between 1 mm and 2 mm, preferably 1.2 mm, and each extension extends beyond the outer face by a distance generally equal to the respective diameter.

13 Claims, 3 Drawing Sheets

SHOWER HEAD

FIELD OF THE INVENTION

The present invention relates to a shower head. More particularly this invention concerns a shower head specially set up for removing any lime from its flow perforations.

BACKGROUND OF THE INVENTION

A standard shower head has a body forming a pressurizable compartment one wall of which is formed with an array of throughgoing perforations. When the compartment is pressurized, respective streams of water emerge from the perforations.

These perforations are of fairly small diameter, at most a few millimeters, and the outer or downstream face of the perforated wall is exposed to the atmosphere. Thus any water on the outer face will dry and, if it is rich in calcium, will leave lime deposits behind, in particular at the edges of the flow perforations.

German patent document 3,107,808 filed 28 February 1981 by Fritz Wagner describes a shower head having a lining formed with a plurality of elastomeric nipples that project through the flow holes. These nipples normally collapse and are closed, but when the head is pressurized they open up to emit respective streams of water. Thus any lime formations will be minimal, and will normally be flushed away due both to the erosion of the water stream acting on them and the poor hold on the elastomeric material. Such an arrangement is fairly complicated and the spray produced by it is highly variable with pressure.

Another shower head is described in German patent document 3,044,310 filed 25 November 1980 by Willy Orszullok. It has a liner With a plurality of nipples which, unlike the above-described Wagner system, do not close when unpressurized but which extend through respective holes in a guide plate. This plate can be shifted to direct the sprays emerging from the nipples. There is no significant lime-removing system here.

OBJECTS OF THE INVENTION

It is therefore an object of the present invention to provide an improved shower head.

Another object is the provision of such an improved shower head which overcomes the above-given disadvantages, that is which can easily be cleared of lime deposits.

SUMMARY OF THE INVENTION

A shower head according to this invention has a body having a wall and forming therewith a pressurizable compartment. This wall has an inner face in the compartment and an outer face and is formed therebetween with an array of throughgoing perforations. Respective flexible tubular extensions are provided on the outer face of the wall at the perforations. These extensions can be deformed to flake off lime formations adhering to the extensions. The extensions can be unitary with the wall, in which case the wall is made of an elastomer, or respective tubular liners in the perforations having outer ends projecting past the outer face can form the respective extensions. In this case each liner can have laterally projecting inner and outer ridges respectively bearing against the inner and outer faces of the wall. Furthermore in accordance with the invention each liner has a predetermined diameter of between 1 mm and 2 mm, preferably 1.2 mm, and each extension extends beyond the outer face by a distance generally equal to the respective diameter.

The extensions can be deformed by a plate carried on the wall and engageable with the extensions. This plate can be formed with respective throughgoing holes alignable in a use position with the extensions. The extensions project into the respective holes in the use position. The wall can be movable relative to the plate or vice versa. In the latter case the wall is formed with a central hub and the plate is provided with a pivot engaged through it with the hub. The plate further is provided with finger-hold formations permitting it to be gripped and rotated on the hub.

The lime-stripping plate according to the invention can also be spaced from the outer face of the perforated wall and from the extensions. Bumps on this plate can engage with the extensions to deform them and flake off the lime on them. Furthermore a detent arrangement is provided to retain this plate in a position with its holes aligned with the extensions, such a detent being a simple spring-loaded catch system.

To further reduce the ability of lime deposits from adhering to the extensions, they each have an outer end of outwardly decreasing wall thickness.

In accordance with a further feature of the invention each of the flexible tubular extensions on the outer face of the wall at the perforations is formed of an elastomer having a Shore hardness of 20 to 100. These projections are tubular and have a wall thickness of between 0.1 mm and 3.0 mm and project between 0.1 mm and 4.0 mm outward past the outer wall. With such an o arrangement the extensions can be cleared simply by being brushed with the hand, as they are soft enough to deformed manually.

BRIEF DESCRIPTION OF THE DRAWING

The above and other objects, features, and advantages will become more readily apparent from the following, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
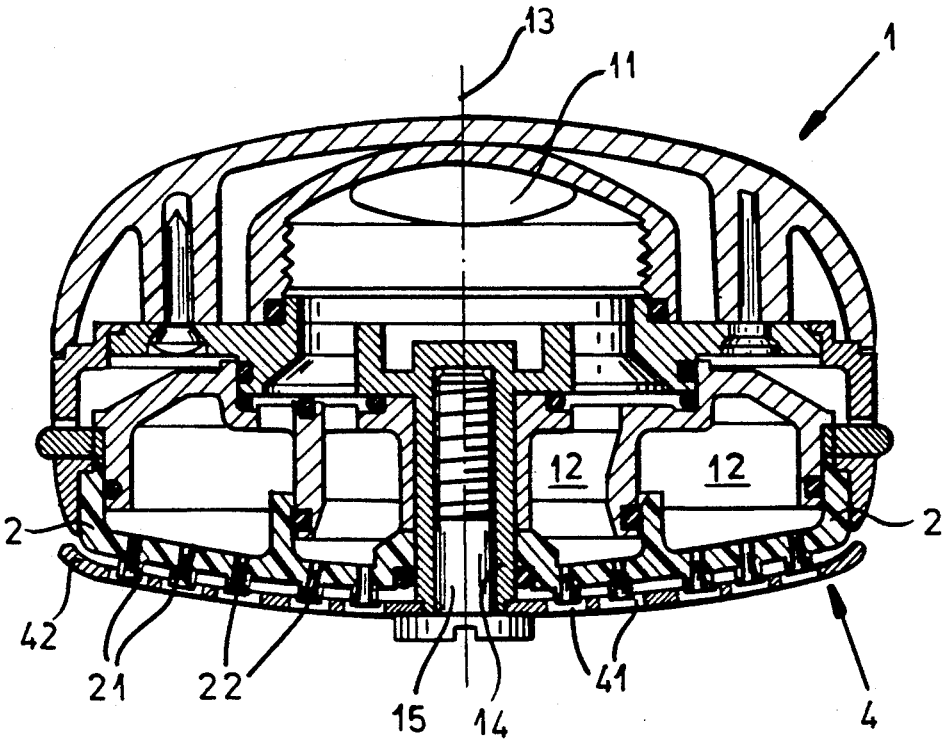
FIG. 1 is a cross section through a shower head according to the invention.

As seen in FIG. 1 a shower head 1, here constituted as a telephone-type personal shower shown in cross section through its spray end, has an inlet 11 opening into a chamber 12 defined in part by a thick elastomeric wall 2 formed with a plurality of throughgoing holes 22 of cylindrical shape. The holes 22 are in an array centered on an axis 13. The outer face of the wall 2 is formed at each hole 22 with a short extension 21 that is considerably thinner than the wall 2 so that these extensions 22 can be deformed relatively easily. The holes 22 have a diameter of about 1.2 mm and the extensions 21 project some 2.5 mm past the outer downstream face of the wall 2 and have a wall thickness of about 0.5 mm.

Figure 5:
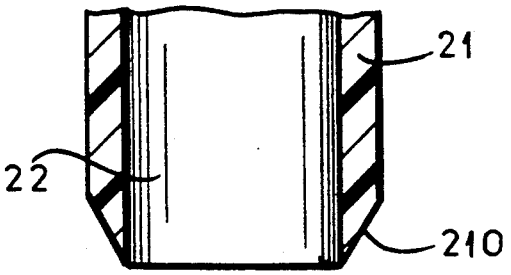

The shower head 1 carries a hub 14 to which a screw 15 secures a lime-stripping plate or disk 4 that can be rotated on the hub about its axis 13. This plate 4 is formed with an array of holes 41 that can be aligned with the holes 22, but that are of much larger diameter than the outer diameters of the extensions 21. An unillustrated detent system holds the plate 4 normally in a position with the holes 41 aligned with the holes 22, and the plate 4 is provided with finger formations 42 that can be gripped to rotate it between adjacent positions. The projections 21 extend slightly into but not through the holes 41 so that as the disk 4 is rotated it deflects and deforms these projections 21 briefly, causing any hard lime formations on them to chip off. As seen in FIG. 5 the ends can be tapered at 210 to have sharp outer edges, thereby facilitating their deformation and further decreasing the ability of lime deposits to form on them.

Figure 2:
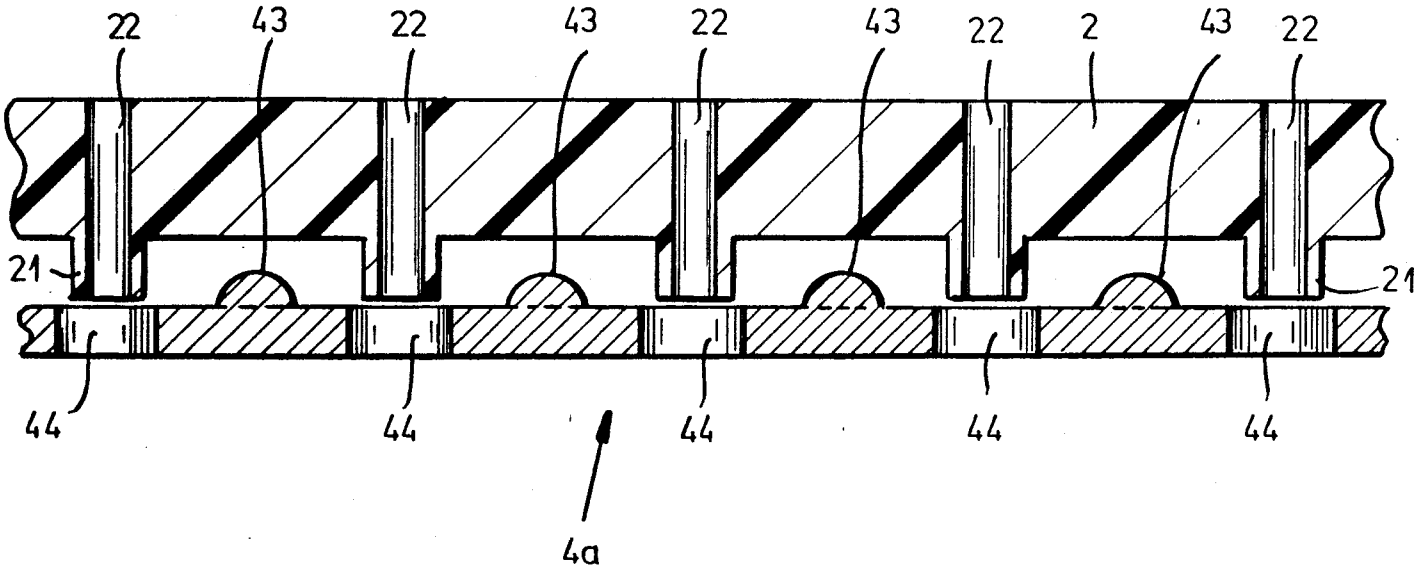
FIGS. 2, 3, 4, and 5 are large-scale sections through details of other arrangements in accordance with the invention.

In FIG. 2 an arrangement is shown where a plate 4*a* formed with holes 44 like the holes 41 is stationary and the wall 2 is movable. Here also the plate 4*a* is spaced from the outer face of the wall 2 by a distance equal to more than the distance the extensions 21 project from this face so that the extensions 21 do not project into the holes 44. To deform them the plate 4*a* is provided on its back or inner surface with bumps 43 that, when this plate 4*a* is turned, engage and deform the extensions 21.

Figure 3:
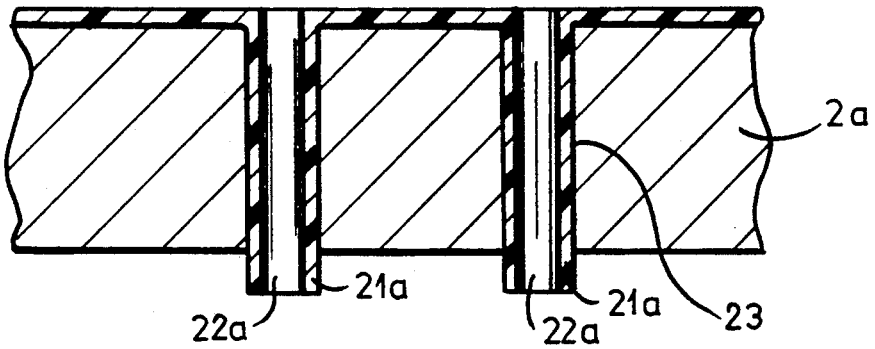
Figure 4:
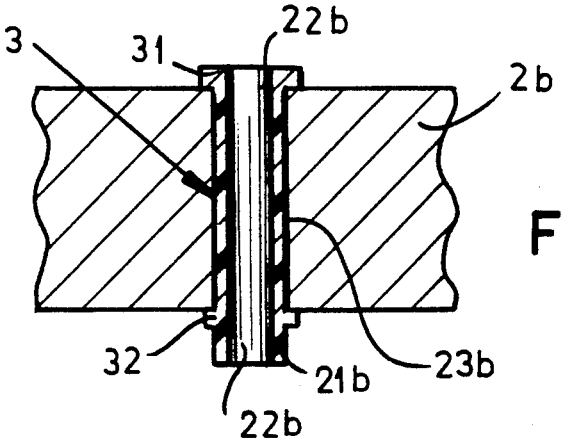

The system of FIG. 3 shows a plate 2*a* formed with bores 23 fitted with liners 22*a* forming extensions 21*a*. This liner is continuous on the inner or upstream face of the plate 2*a*. In FIG. 4 individual liner tubes 3 are provided that are fitted in bores 23*b* to form the holes 22*b* and the extensions 21*b*. To hold these individual tubes 3 in place they are formed with inner and outer radially projecting ridges 31 and 32 that respectively engage the inner and outer faces of the plate 2*b*.

We claim:

1. A shower head comprising:

a body having a wall and forming therewith a pressurizable compartment, the wall having an inner face in the compartment and an outer face being formed between the faces with an array of throughgoing perforations; and respective flexible and normally open tubular liners in the perforations having outer ends projecting past the outer face of the wall at the perforations, and laterally projecting inner and outer ridges respectively bearing against the inner and outer faces of the wall, whereby lime formations adhering to the outer ends are flaked therefrom on deformation of the outer ends.

2. The improved shower head defined in claim 1 wherein each liner has a predetermined diameter and each outer end extends beyond the outer face by a distance generally equal to the respective diameter.

3. The improved shower head defined in claim 2 wherein the diameter is between 1 mm and 2 mm.

4. The improved shower head defined in claim 3 wherein the diameter is about 1.2 mm.

5. The shower head defined in claim 1 wherein the extensions are formed of an elastomer having a Shore hardness of 20 to 100.

6. The shower head defined in claim 5 wherein the outer ends are tubular and have a wall thickness of between 0.1 mm and 3.0 mm and project between 0.1 mm and 4.0 mm outward past the outer wall.

7. The improved shower head defined in claim 1 wherein each of the extensions has an outer end of outwardly decreasing wall thickness.

8. A shower head comprising:

a body having a wall and forming therewith a pressurizable compartment, the wall having an inner face in the compartment and an outer face being formed between the faces with an array of throughgoing perforations;

respective flexible and normally open tubular extensions on the outer face of the wall at the perforations and each having laterally projecting inner and outer ridges respectively bearing against the inner and outer faces of the wall; and means including a plate carried on the wall and engageable with the extensions for deforming the extensions, whereby lime formations adhering to the extensions are flaked therefrom on deformation of the extensions.

9. The improved shower head defined in claim 8 wherein the plate is formed with respective throughgoing holes alignable in a use position with the extensions, the extensions projecting into the respective holes in the use position.

10. The improved shower head defined in claim 9 wherein the wall is movable relative to the plate for engagement with the extensions.

11. The improved shower head defined in claim 9 wherein the plate is pivotal on the wall.

12. The improved shower head defined in claim 11 wherein the wall is formed with a central hub and the plate is provided with a pivot engaged through it with the hub, the plate further being provided with finger formations permitting it to be gripped and rotated on the hub.

13. A shower head comprising:

a body having a wall and forming therewith a pressurizable compartment, the wall having an inner face in the compartment and an outer face being formed therebetween with an array of throughgoing perforations;

respective flexible and normally open tubular extensions on the outer face of the wall at the perforations and each having laterally projecting inner and outer ridges respectively bearing against the inner and outer faces of the wall; and means on the shower head for deforming the extensions, the means for deforming including a plate carried on the wall spaced from the outer face of the wall and from the extensions and formed with holes alignable in a use position with the respective extensions, the plate being formed with bumps laterally engageable on displacement out of the use position with the extensions to deform same, whereby lime formations adhering to the extensions are flaked therefrom on deformation of the extensions by engagement with the bumps.

* * * * *